US008808115B2

(12) United States Patent
DeTroia

(10) Patent No.: US 8,808,115 B2
(45) Date of Patent: Aug. 19, 2014

(54) FOOTBALL TACKLING DUMMY APPARATUS

(76) Inventor: Anthony D. DeTroia, Farmingdale, NY (US)

( * ) Notice: Subject to any disclaimer, the term of this patent is extended or adjusted under 35 U.S.C. 154(b) by 255 days.

(21) Appl. No.: 13/462,416

(22) Filed: May 2, 2012

(65) Prior Publication Data

US 2012/0283047 A1 Nov. 8, 2012

Related U.S. Application Data

(60) Provisional application No. 61/518,317, filed on May 3, 2011.

(51) Int. Cl.
*A63B 69/34* (2006.01)
*A63B 69/00* (2006.01)

(52) U.S. Cl.
CPC ..... *A63B 69/34* (2013.01); *A63B 69/345* (2013.01); *A63B 69/002* (2013.01); *A63B 69/00* (2013.01)
USPC ..... 473/443; 473/438

(58) Field of Classification Search
CPC .... A63B 69/004; A63B 69/002; A63B 69/34; A63B 69/345; A63B 2243/007; A63B 2243/0066; A63B 2243/0025
USPC ..... 473/422, 438, 441–445; D21/798, 787; 482/83–90
See application file for complete search history.

(56) References Cited

U.S. PATENT DOCUMENTS

| | | | | | |
|---|---|---|---|---|---|
| 704,265 | A * | 7/1902 | McMaster | 473/442 |
| 1,611,194 | A * | 12/1926 | Henderson | 473/442 |
| 1,906,693 | A * | 5/1933 | Loughlin | 473/442 |
| 1,917,208 | A * | 7/1933 | Maddock | 473/442 |
| 2,037,508 | A * | 4/1936 | Gilman | 473/444 |
| 2,237,599 | A * | 4/1941 | Gilman | 473/444 |
| 2,466,954 | A * | 4/1949 | King | 473/443 |
| D168,302 | S * | 12/1952 | Holt | D29/100 |
| 3,659,848 | A * | 5/1972 | DePew | 473/443 |
| 4,103,889 | A * | 8/1978 | Lobur | 482/86 |
| 5,281,191 | A * | 1/1994 | DeSousa | |
| 5,800,319 | A * | 9/1998 | Choate | 482/83 |
| 6,261,195 | B1 * | 7/2001 | Shingleton | 473/442 |
| 6,302,831 | B1 * | 10/2001 | Henry | 482/83 |
| D584,785 | S * | 1/2009 | McDonald | D21/787 |
| 7,736,248 | B2 * | 6/2010 | Eldridge | 473/445 |

* cited by examiner

*Primary Examiner* — Mitra Aryanpour
(74) *Attorney, Agent, or Firm* — Gerald T. Bodner

(57) ABSTRACT

A football tackling dummy apparatus includes a tackling dummy, a support structure for suspending the tackling dummy therefrom, and a release mechanism. The release mechanism is mounted on the support structure and situated between the support structure and the tackling dummy. The tackling dummy is releasably attached to the release mechanism and is released thereby when a predetermined force is applied to the tackling dummy.

26 Claims, 6 Drawing Sheets

FOOTBALL TACKLING DUMMY APPARATUS

CROSS-REFERENCE TO RELATED APPLICATIONS

This application is related to U.S. Provisional Patent Application Ser. No. 61/518,317, which was filed on May 3, 2011, and is entitled "Football Tackling Dummy Apparatus", the disclosure of which is hereby incorporated by reference and on which priority is hereby claimed.

BACKGROUND OF THE INVENTION

1. Field of the Invention

The present invention generally relates to football tackling dummies, and more specifically relates to football tackling dummies suspended from an overhead device.

2. Description of the Prior Art

Physical sports such as football require players to become proficient at performing certain techniques. In football, players must frequently be able to tackle their opponents in both offensive and defensive maneuvers. As such, the success of both offensive and defensive plays hinges on the athlete's ability to properly tackle the opposing team's players. In addition to the obvious importance of proper tackling techniques relative to the success of the game, if proper tackling techniques are not utilized, injuries to the players often result.

Conditioning players to utilize proper tackling techniques is often accomplished using tackling dummies. Conventionally, tackling dummies are generally cylindrical in shape and are mounted to a skid or carriage that may be pushed along the field. Players line up in front of the tackling dummy and, upon command, tackle the dummy by exerting force upon it. The dummy's movement is limited by the friction between the carriage mounted thereto and the field, thus providing strength training to the player.

In other conventional designs, tackling dummies are disproportionately weighted, the heavier side being positioned near the bottom end, and are freestanding on the field. A player may simply tackle the dummy, the dummy reverting back to its original upright position once the player removes himself. Some tackling dummies are also suspended from an overhead device.

The conventional tackling dummies are limited in that they do not require the player to utilize proper technique while performing a tackle. The conventional dummies may be pushed, knocked over or detached by simply exerting force upon the dummy. As such, the conventional dummies act more as strength training devices as opposed to conditioning devices that force the player to train utilizing proper technique. In addition, the conventional tackling dummies are static, i.e., they are fixed and do not move with respect to the mounting platform thereon, providing little coordination training to the athlete. Furthermore, the conventional tackling dummies are often difficult and tedious to reposition after training. For example, conventional dummies that are mounted to a carriage must be dragged back to the starting position at the end of each training repetition. Similarly, conventional dummies that are suspended are often difficult to reattach after training.

The present invention provides a novel tackling dummy that promotes proper tackling technique during training that overcomes the inherent disadvantages of the conventional tackling dummies.

OBJECTS AND SUMMARY OF THE INVENTION

It is an object of the present invention to provide a tackling dummy that provides coordination training for an athlete, especially a football player.

It is another object of the present invention to provide a football tackling dummy apparatus having a suspended tackling dummy which may be easily reattached to the apparatus during training.

It is still another object of the present invention to provide a tackling dummy which includes a ring that is adjustable to a proper height to train an athlete to properly tackle an opponent.

It is a further object of the present invention to provide a football tackling dummy apparatus which includes an adjustable tension release mechanism that releases the dummy when a particular level of force is applied thereto.

It is yet a further object of the present invention to provide a football tackling dummy apparatus which overcomes the inherent disadvantages of known tackling dummy apparatus.

In one form of the present invention, a sports training apparatus, and in particular, a football tackling dummy apparatus, includes a tackling dummy, a support structure for suspending the tackling dummy therefrom, and a release mechanism for selectively releasing the tackling dummy from the support structure when a certain force is applied to the tackling dummy, that is, when a football player tackles the dummy.

The release mechanism is mounted on the support structure and situated between the support structure and the tackling dummy. The tackling dummy is releasably attached to the release mechanism and is released thereby when a sufficient force is applied to the tackling dummy.

The release mechanism preferably includes a pair of spaced apart brackets, a tensioner situated between the brackets, and support pieces mounted on the brackets that face each other.

The tackling dummy has a main body and an elongated shaft that extends outwardly from the top end portion of the main body. On the distal end of the elongated shaft is an enlarged head.

The support pieces on the release mechanism define a central opening between them. This central opening receives the elongated shaft extending from the main body of the tackling dummy, but when no force is applied to the tackling dummy, the diameter of the central opening is smaller than that of the enlarged head so that only the shaft of the tackling dummy may pass through the opening defined by the support pieces, but the enlarged head may not, and rests on top of the support pieces, when no force or an inadequate force is applied to the tackling dummy.

However, when sufficient force is applied to the tackling dummy, the brackets and support pieces mounted thereon will separate against the bias of the tensioner between the brackets, and the opening between the support pieces will enlarge to a diameter which is greater than that of the enlarged head of the tackling dummy so that the enlarged head will pass through the opening, or space, between the support pieces and will be released thereby.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
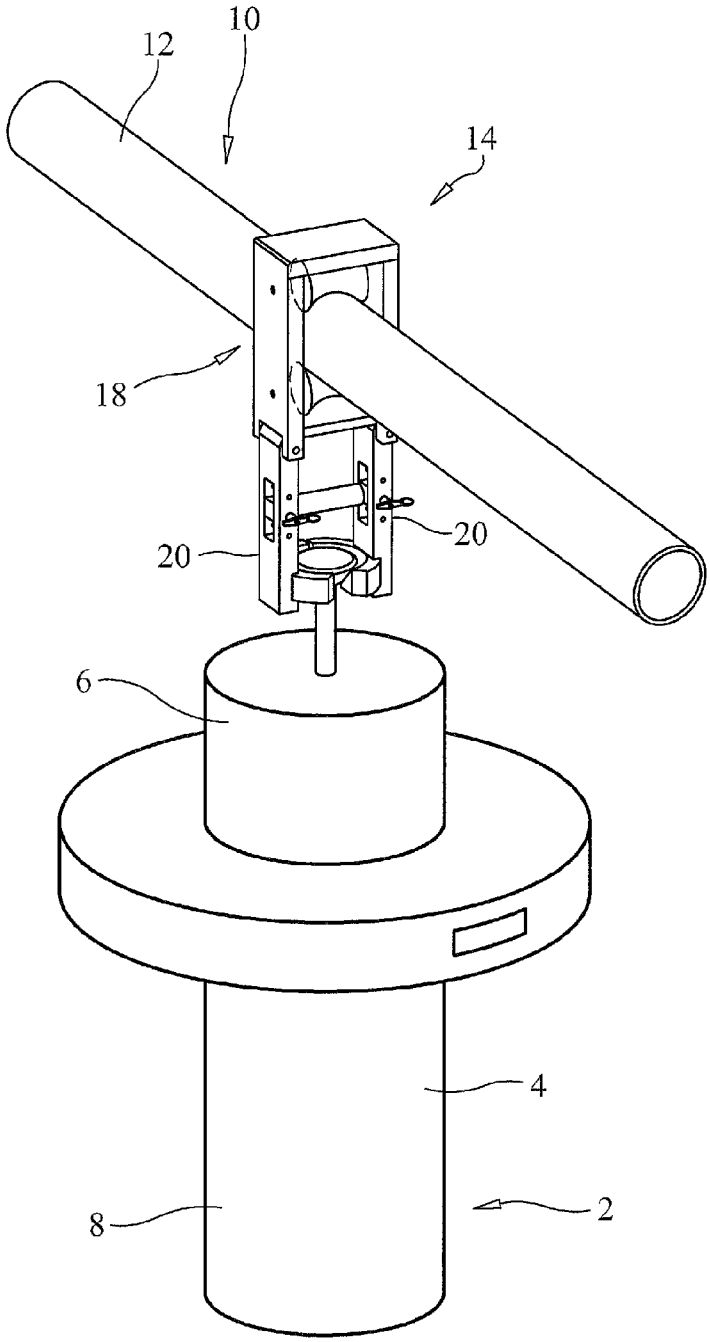
FIG. 1 is front perspective view of a tackling dummy formed in accordance with a preferred embodiment of the present invention, showing the tackling dummy engaged with a hanging bracket.
Figure 2:
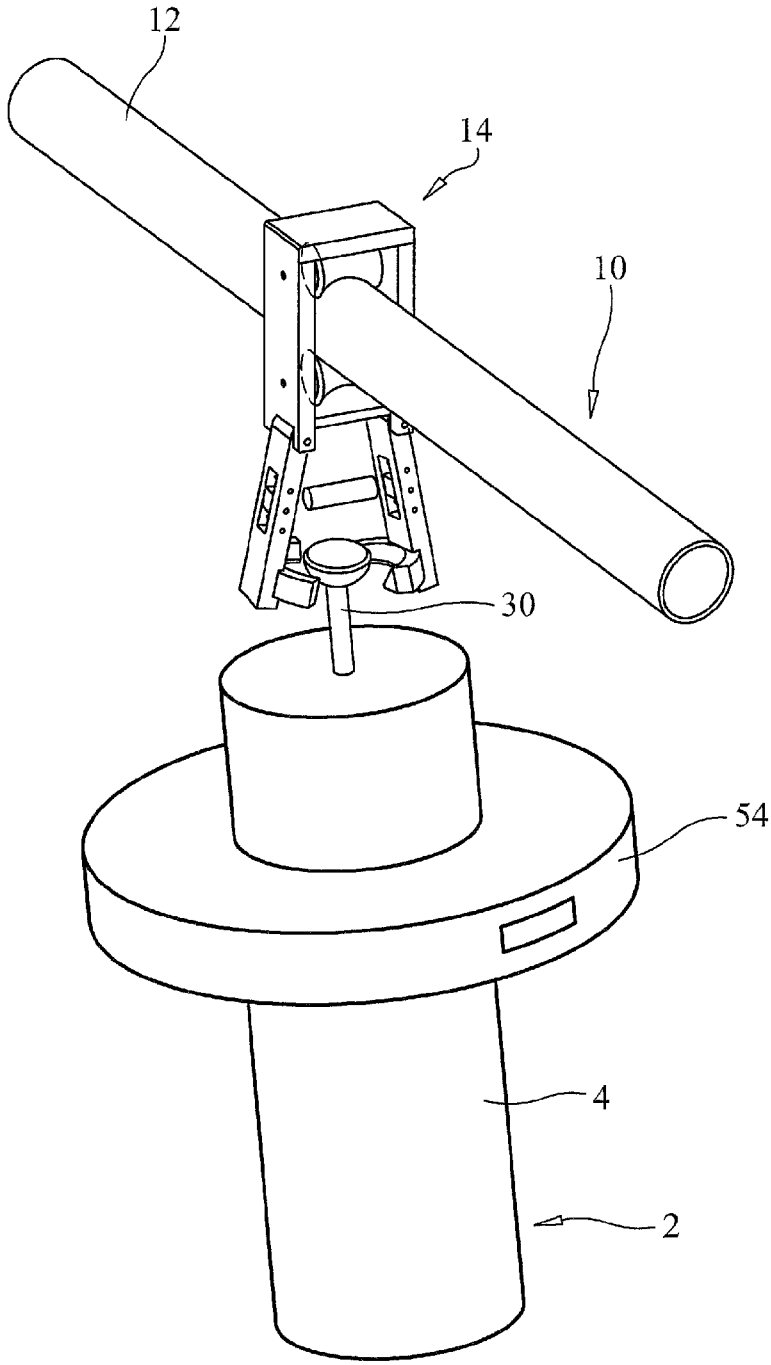
FIG. 2 is front perspective view of the tackling dummy formed in accordance with a preferred embodiment of the present invention, showing the tackling dummy disengaged from the hanging bracket.
Figure 3:
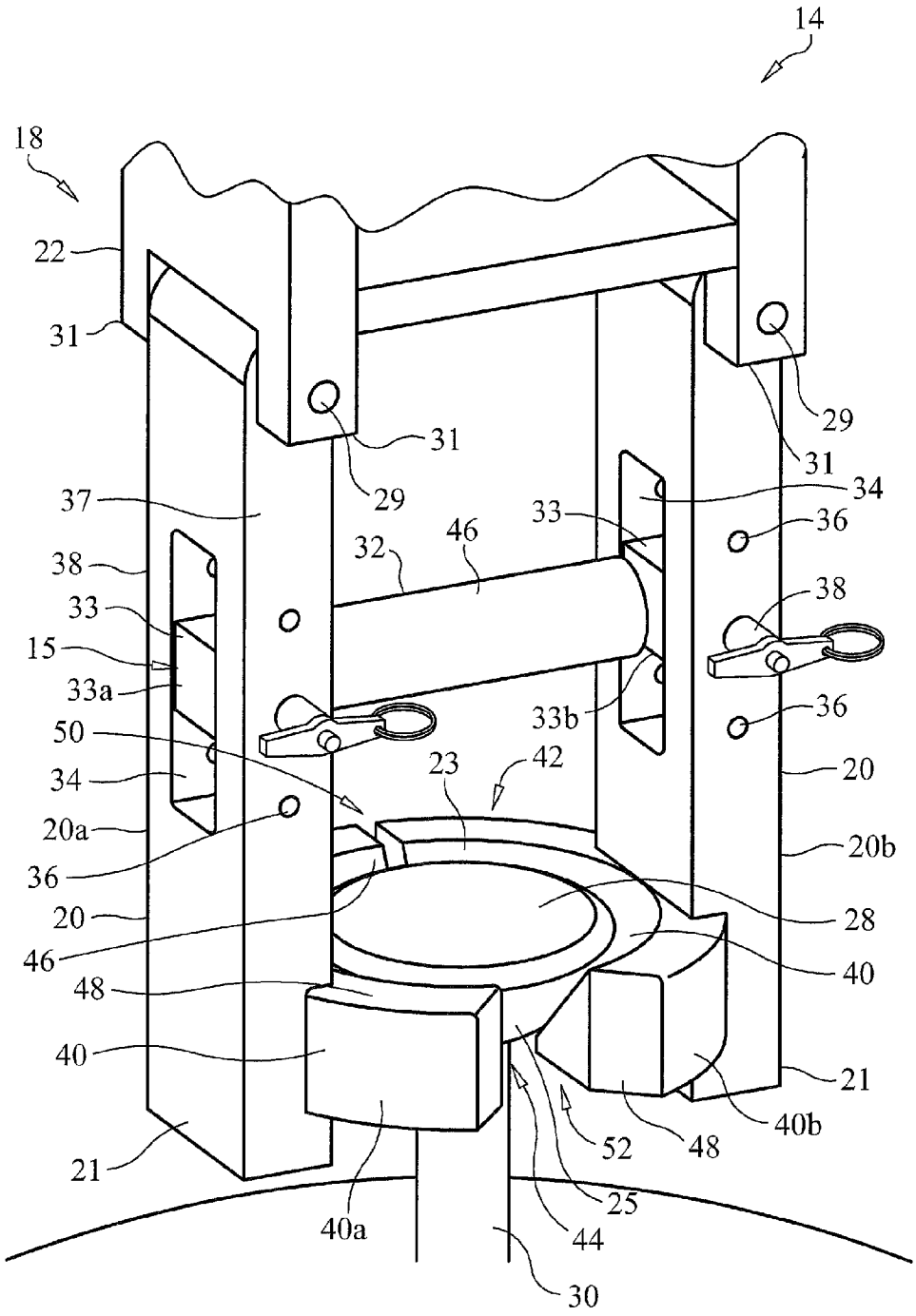
FIG. 3 is an enlarged perspective view of a carriage assembly formed in accordance with a preferred embodiment of the present invention.

As can be seen from FIGS. 1-3, the present invention provides a tackling dummy 2 and overhead track assembly 10.

Initially referring to FIGS. 1-2 of the drawings, a tackling dummy 2 formed in accordance with the present invention includes a main body 4, the main body 4 being generally cylindrical in shape having a top end 6 and opposite bottom end 8. The main body 2 is preferably covered with a padded material to prevent impact injuries to an athlete during training. The main body 2 is suspended from an overhead track assembly 10 and moveable along an axial length thereof.

Figure 4:
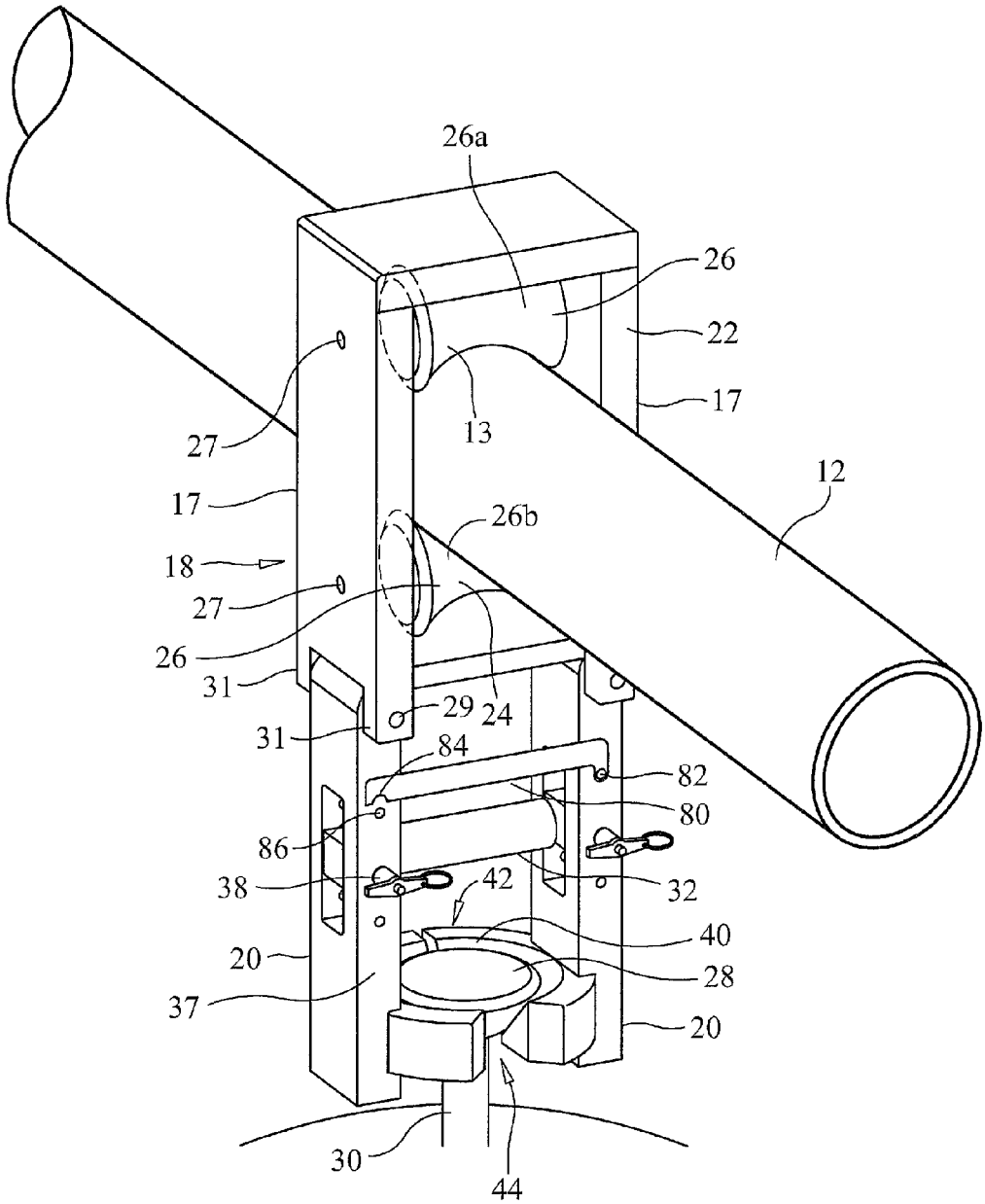
FIG. 4 is an enlarged perspective view of the carriage assembly formed in accordance with a preferred embodiment of the present invention, showing a rail within a roller assembly.
Figure 5:
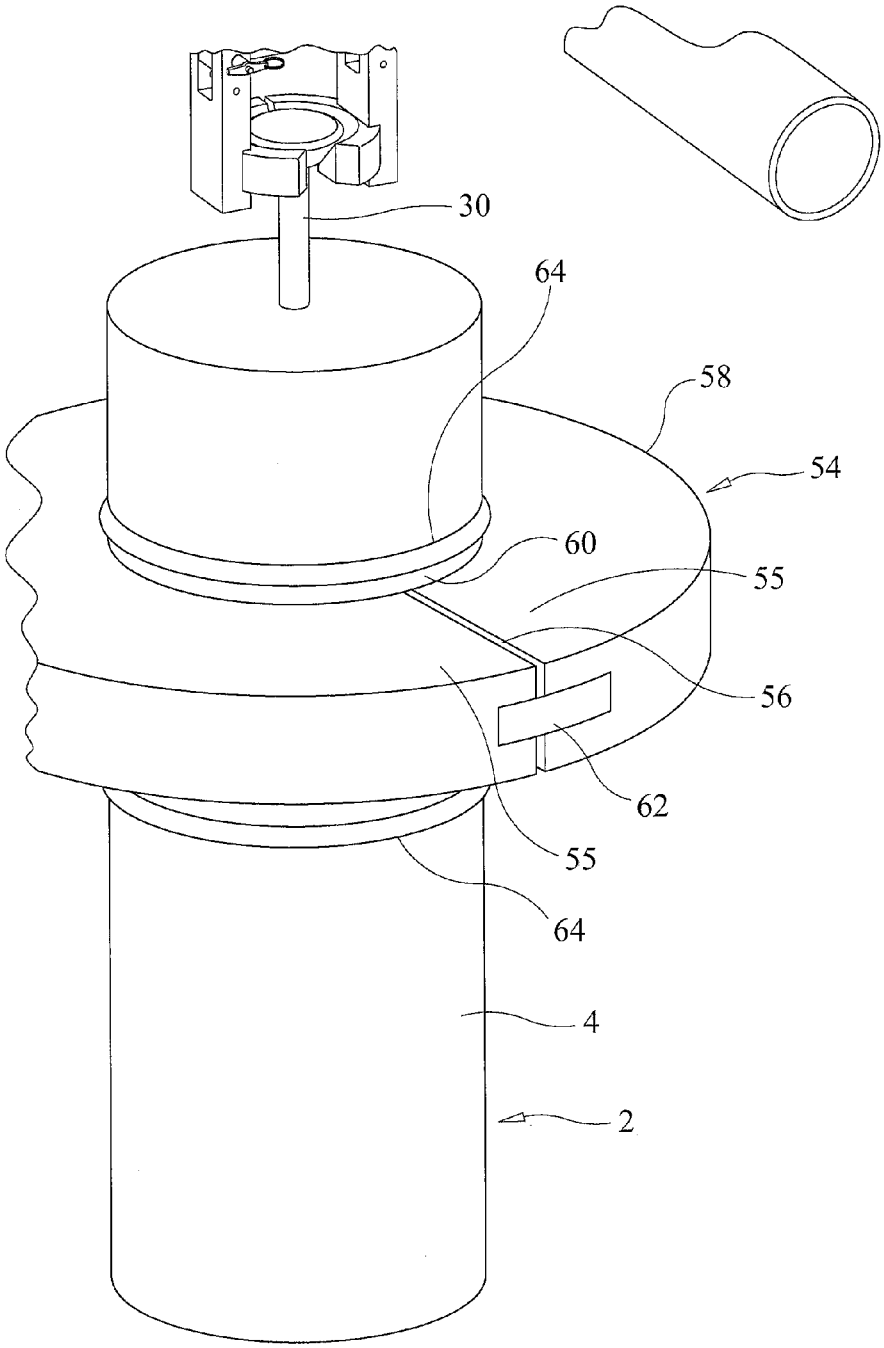
FIG. 5 is an enlarged perspective view of the tackling dummy formed in accordance with a preferred embodiment of the present invention, showing a height adjustment ring.

Referring to FIGS. 1-2 and 4 of the drawings, it will be seen that the overhead track assembly 10 formed in accordance with the present invention includes an elongated tubular rail 12 and carriage assembly 14 moveable thereon. The track assembly 10 further includes two support members (not shown) which support the tubular rail 12 at opposite ends thereof. The support members may be formed as A-frame type structures, allowing the track assembly 10 to be portable. Alternately, the support members may be formed as single posts, tripods or any other structure that would adequately support the tubular rail 12 and tackling dummy 2 suspended therefrom. Furthermore, one or both ends of the tubular rail 12 may be supported by a permanent structure such as a building. Preferably, the rail 12 is about 20 feet in length.

The carriage assembly 14 comprises a roller assembly 18 and hanging brackets 20. As shown in FIG. 4 of the drawings, the roller assembly 18 includes a generally rectangular support frame 22 having spaced apart brackets 17 defining an inner space 24 in which at least one roller 26 is positioned. Preferably, two concave rollers 26 are positioned within the inner space 24 of the support frame 22 and the spaced apart brackets 17 thereof, the rollers 26 being rotatably mounted on shafts 27 extending between the opposite brackets 17 of the support frame 22, the rail 12 being positioned either below the at least one roller 26 or between the two rollers 26, allowing the roller assembly 18 and support frame 22 to be moveable along the length of the rail 12. The hanging brackets 20 are preferably hingedly connected to the support frame 22, on pins 29 passing through the thicknesses of the brackets 20 and into extended forked ends 31 of each bracket 20, the hanging brackets 20 being situated between the forked ends 31 and extending downwardly therefrom. The hanging brackets 20 receive the enlarged head 28 of a shaft 30 extending from the main body 4 of the tackling dummy 2 at the top end 6 thereof.

The carriage assembly 14 further includes a tension cylinder 32 situated between and connected to the hanging brackets 20 for biasing the hanging brackets 20 inwardly, towards each other. The tension cylinder 32 may be pneumatic, hydraulic, a spring or any other similar device that would adequately bias the brackets 20 towards each other. The tension cylinder 32 may be adjustably positionable within a window 34 formed within the axial length of each hanging bracket 20 through the thickness thereof. As shown in FIG. 3 of the drawings, preferably, at least one hole (not shown) is formed at each end of the tension cylinder 32, which end resembles a cube-shaped block 33 in FIG. 3. The holes in the tension cylinder ends may be aligned with at least one corresponding hole 36 formed through the opposite lateral sides 37 of the hanging brackets 20. The tension cylinder 32 may be adjustably secured at a specific position within the window 34 of each bracket 20 by aligning the holes in the tension cylinder 32 with the holes 36 in the hanging bracket 20 and inserting a pin 38 therethrough. The tension required to spread the hanging brackets 20 apart may be varied by adjusting the position of the tension cylinder 32 therebetween. For example, the force required to spread the hanging brackets 20 apart may be increased by adjusting the tension cylinder 32 to a lower position within the windows 34. Alternatively, the force required to spread the hanging brackets 20 apart may be decreased by adjusting the tension cylinder 32 to a higher position within the windows 34.

Each hanging bracket 20 further includes a hemispherical concave cup portion 40 extending inwardly of the space 24 from a bottom end thereof, each portion 40 being a mirror image of the other in structure. As can be seen in FIG. 3 of the drawings, when the hanging brackets 20 are fully retracted, i.e., in a closed position, the hemispherical concave cup portions 40 together define a hemispherical support cup 42 having a concave inner surface 23 and a central bore 44 therein for supporting the head 28 of the shaft 30 extending from the main body 4 of the tackling dummy 2, as will be described in the forthcoming paragraph. The hemispherical cup portions 40 are preferably asymmetrically formed, having a first curved end 46 and a second curved end 48, the first curved end 46 being slightly longer than the second curved end 48. As such, when the hanging brackets 20 are fully retracted, the hemispherical cup 42 includes a first slot 50 between the first curved ends 46 of the hemispherical concave cup portions 40, and a second slot 52 between the second curved ends 48. The second slot 52 is preferably larger (wider) than the first slot 50 and dimensioned to be greater than the diameter of the shaft 30 but less than the diameter of the head 28.

As stated previously, the main body 4 of the tackling dummy 2 includes an elongated shaft 30 extending upwardly from the top end 6 thereof. The shaft 30 is affixed to a hemispherically shaped head 28 with a convex underside surface 25 (complementary in shape to that of cup 42) that is received by the hemispherical concave cup 42 defined by the pair of hemispherical concave cup portions 40 extending inwardly from the hanging brackets 20. The tackling dummy 2 is suspended from the carriage assembly 14 by positioning the head 28 of the shaft 30 above the hemispherical cup 42 and inserting the shaft 30 through the larger second slot 52 such that it is positioned within the bore 44 of the hemispherical cup 42.

As the dummy 2 is lowered, the shaft 30 extending therefrom moves downwardly within the bore 44 of the hemispherical cup 42 until the convex underside surface 25 of the head 28 of the shaft 30 rests on and is supported by the concave inner surface 23 of the hemispherical cup 42. The bore 44 defined by the two cup portions 40 has a diameter which is larger than that of the shaft 30 but smaller than that of the head 28. As the head 28 does not fit through the bore 44 of the hemispherical cup 42, the inwardly biased hanging brackets 20 hold the hemispherical cup portions 40 together to support the head 28 resting thereon, thus suspending the tackling dummy 2 hanging therefrom. The convex head 28 is pivotable omni-directionally within the concave cup 42. Accordingly, the suspended tackling dummy 2 may rotate, sway and be free to move while suspended.

The main body 4 of the dummy 2 further includes a height adjustable ring 54 circumferentially attachable thereto. The height adjustable ring 54 is preferably formed as a circular or C-shaped member having a break 56 therein, the ring having an outer diameter 58 and an inner diameter 60. The ring 54 is covered with a padded material to prevent injury to the athlete during training. The ring 54 may be moved upwardly and downwardly with respect to the main body 4 of the tackling dummy 2 to train the athlete to properly tackle an opponent. More specifically, the ring 54 forces the player to tackle and grasp the main body 4 below the ring 54 because the player is unable to wrap his arms around the relatively wide ring 54, forcing the player to tackle the portion of the main body 4 below the ring 54. The ring 54 may be positioned by wrapping the ring 54 around the main body 4 and securing the ends separated by the break 56 therein by a strap 62 such as Velcro™, a buckle or lacing. Alternatively, the ring 54 may be formed as a completely circular member, i.e., not including a break therein. The ring 54 may be adjusted upwardly and downwardly on the main body 4 and can be supported by at least one, but preferably two, elastic supporting bands 64, such as Bungee cords, or non-elastic but tightenable straps positioned on the main body 4 above and below the ring 54. The supporting bands 64, being secured about the main cylindrical body 4 in a desired position, take on a circle with an outer diameter that is larger than the inner diameter 60 of the ring 54 and thus limit the movement of the ring 54 with respect to the main body 4.

During training, an athlete may line up at an end of the track assembly 10, in front of or beside the tackling dummy 2 suspended therefrom. The appropriate tension for release of the dummy 2 may be adjusted by moving the tension cylinder 32 upwardly or downwardly within the windows 34 of the hanging brackets 20. The ring 54 positioned around the main body 4 is adjusted to a proper height to train the athlete to properly tackle an opponent. The athlete approaches and tackles the tackling dummy 2 suspended from the carriage assembly 14, which is free to travel along the rail 12 until the athlete performs a proper tackle, i.e., applying a correctly directed force to the tackling dummy 2. After the athlete has performed a proper tackle, the head 28 of the shaft 30 forces the hemispherical cup portions 40 apart against the bias of the tension cylinder 32. The head 28 of the shaft 30 and tackling dummy 2 attached thereto are then free to fall from the hanging brackets 20 to the ground. The dummy 2 is easily suspended again by inserting the shaft 30 through the larger second slot 52 defined by the hemispherical cup portions 40 and lowering the dummy 2 so that the convex head 28 is once again supported by the concave cup 42 defined by the cup portions 40 of the hanging brackets 20.

From the foregoing description, and as can be seen from FIGS. 1-5, a tackling dummy apparatus, especially for football practice, preferably includes a tackling dummy 2, a support structure 10 for suspending the tackling dummy therefrom, and a release mechanism 15 mounted on the support structure 10 and situated between the support structure and the tackling dummy 2. The tackling dummy 2 is releasably attached to the release mechanism 15 and is released thereby when a sufficient force is applied to the tackling dummy, such as when a football player tackles the dummy during practice.

More specifically, the release mechanism 15 includes a first bracket 20*a* and a second bracket 20*b*. Each of the first and second brackets 20*a*, 20*b* has an end portion 21. The first bracket 20*a* and the second bracket 20*b* are adjustably spaced from each other and are movable relative to each other between at least a first, closed relative position, in which the end portions 21 thereof are spaced apart from each other a first distance, and a second, open relative position, in which the end portions 21 thereof are spaced apart from each other a second distance which is greater than the first distance.

The release mechanism 15 further includes a tensioner 32 situated between and coupled to the first and second brackets 20*a*, 20*b* and biasing the first and second brackets toward one another and into the first, closed relative position.

The release mechanism 15 also includes a first cup portion 40*a* and a second cup portion 40*b*. The first cup portion 40*a* is joined to the end portion 21 of the first bracket 20*a*, and the second cup portion 40*b* is joined to the end portion 21 of the second bracket 20*b* and facing the first cup portion 40*a*. The first cup portion 40*a* and the second cup portion 40*b* are in close proximity to each other when the first and second brackets 20*a*, 20*b* are in the first, closed relative position to define a support cup 42 having a concave inner surface 23 and a central opening 44 formed in the support cup, and are separated from each other by a space when the first and second brackets 20*a*, 20*b* are in the second, open relative position.

The tackling dummy 2 preferably includes a main body 4 having a top end portion 6 and a bottom end portion 8 situated axially opposite the top end portion. The dummy 2 also includes an elongated shaft 30 extending axially outwardly from the top end portion 6, the elongated shaft having a distal free end. Furthermore, the dummy 2 has an enlarged head 28 mounted on the distal free end of the shaft 30, the enlarged head 28 having a generally convex underside surface 25.

The head 28 of the tackling dummy 2 is receivable by the support cup 42 defined by the first and second cup portions 40*a*, 40*b* and supported by the support cup, with the convex underside surface 25 of the head 28 facing the concave inside surface 23 of the support cup 42, and with the shaft 28 of the tackling dummy being received by the central opening 44 of the support cup, when the first bracket 20*a* and the second bracket 20*b* are in the first, closed relative position. However, the tackling dummy is released and unsupported by the support cup 42 of the release mechanism 15, with the enlarged head 28 of the tackling dummy 2 passing through the space between the first and second cup portions 40*a*, 40*b*, when the first and second brackets 20*a*, 20*b* are in the second, open relative position. The first and second brackets 20*a*, 20*b* move relative to each other from the first, closed relative position to the second, open relative position when a sufficient force is applied to the tackling dummy 2 releasably mounted on the release mechanism 15, to overcome the bias of the tensioner 32 on the first and second brackets 20*a*, 20*b*.

Stated another way, the release mechanism 15 of the tackling dummy apparatus preferably includes first and second brackets 20*a*, 20*b*, the first and second brackets being spaced apart from each other and being movable relative to each other. The release mechanism 15 also preferably includes a tensioner 32 situated between and coupled to the first and second brackets 20*a*, 20*b*, the tensioner 32 applying a bias on the first and second brackets 20*a*, 20*b* to pull the first and second brackets towards each other. Furthermore, the release mechanism 15 preferably includes first and second cooperating support pieces 40*a*, 40*b* respectively joined to the first and second brackets 20*a*, 20*b*. The first and second support pieces 40*a*, 40*b* face each other and are movable relative to each other with movement of the first and second brackets 20*a*, 20*b* relative to each other. The first and second support pieces 40*a*, 40*b* are positionable between at least a first relative position and a second relative position. The first and second support pieces 40*a*, 40*b* together define an opening 44 between them having a first dimension when the first and second support pieces 40*a*, 40*b* are positioned in the first relative position. The opening 44 between the first and second support pieces 40*a*, 40*b* has a second dimension which is larger than the first dimension when the first and second support pieces 40*a*, 40*b* are positioned in the second relative position.

As stated previously, the tackling dummy 2 preferably includes a main body 4 having a top end portion 6 and a bottom end portion 8 situated axially opposite the top end portion, an elongated shaft 30 extending axially outwardly from the top end portion 6, the elongated shaft 30 having a distal free end, and an enlarged head 28 mounted on the distal free end of the shaft. The enlarged head 28 has a third dimension which is greater than the first dimension of the opening 44 between the first and second support pieces 40*a*, 40*b* when the first and second support pieces are in the first relative position. However, the third dimension of the enlarged head 28 is less than the second dimension of the opening 44 between the first and second support pieces 40*a*, 40*b* when the first and second support pieces are in the second relative position.

The shaft 30 of the tackling dummy 2 is captively received by the opening 44 between the first and second support pieces 40*a*, 40*b*, and the enlarged head 28 is supported by the first and second support pieces, when the first and second support pieces 40*a*, 40*b* are in the first relative position and the opening 44 has the first dimension. However, the enlarged head 28 of the tackling dummy 2 passes through the opening 44 between the first and second support pieces 40*a*, 40*b* and is unsupported thereby when the first and second support pieces move from the first relative position to the second relative position and the opening 44 has the second dimension.

Preferably, the support structure 10 of the tackling dummy apparatus includes an elongated tubular member 12. Furthermore, the tackling dummy apparatus preferably further includes a roller assembly 18. The roller assembly 18 has a pair of spaced apart brackets 17 and at least one roller 26 rotatably mounted to and extending between the spaced apart brackets 17 of the roller assembly. The at least one roller 26 is engageable with the elongated tubular member 12, and the release mechanism 15 is mounted to the roller assembly 18.

However, in an even more preferred foam of the present invention, the roller assembly 18 includes a first roller 26*a* and a second roller 26*b*, the first and second rollers 26*a*, 26*b* being arranged in parallel and being spaced apart from each other. The first and second rollers 26*a*, 26*b* are rotatably mounted to and extend between the spaced apart brackets 17 of the roller assembly. Each of the first and second rollers 26*a*, 26*b* has a concave roller surface 13. The elongated tubular member 12 of the support structure 10 is received between the first and second rollers 26*a*, 26*b*.

In another preferred form of the present invention, the tackling dummy apparatus further includes a tackling training ring 54. The tackling training ring 54 is at least partially circumferentially mounted on the main body 4 of the tackling dummy 2 and is positionable thereon along at least a portion of the axial length thereof. The ring 54 is preferably formed as a C-shaped member having two opposite ends 55 which face each other and which are separated by a space 56.

The ring 54 preferably includes a closure member, such as a strap 62. The closure member 62 straddles the space 56 between the two opposite ends 55 of the C-shaped member, and selectively exerts a force on the ends 55 of the C-shaped member to pull the ends 55 toward each other and to decrease the space 56 therebetween. This is to tighten the C-shaped member about the circumference of the main body 4 of the dummy 2 and to secure the member at a desired position along the axial length thereof.

Furthermore, the tackling dummy apparatus may include at least one strap or supporting band 64. The at least one strap 64 encircles the circumference of the main body 4 of the tackling dummy 2 and is situated thereon either above or below the ring 54 to maintain the ring 54 in a particular position on the main body 4 of the tackling dummy. Two straps 64 may be used to secure the ring 54 in place on the main body 4 of the dummy, one strap 64 being positioned above the ring 54 and the other strap 64 being positioned below the ring.

Figure 6B:
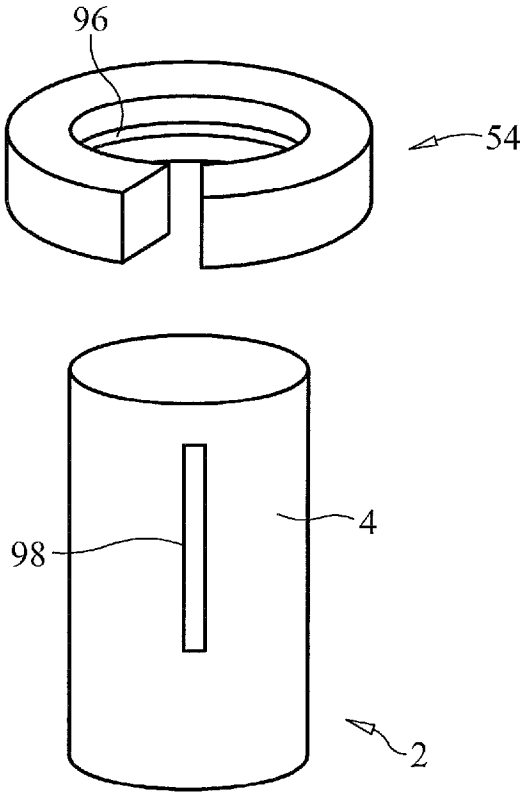
FIGS. 6A and 6B are perspective views of a tackling dummy formed in accordance with a preferred embodiment of the present invention and illustrating how a tackling training ring may be adjustably affixed to the tackling dummy, FIG. 6B being an exploded view.
Figure 6A:
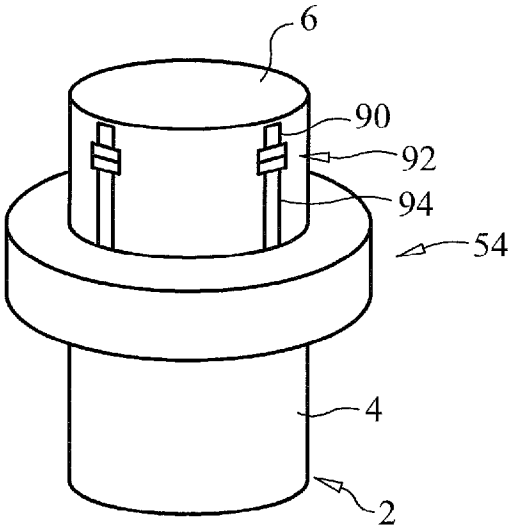

FIGS. 6A and 6B illustrate different ways the training ring 54 may be adjustably affixed to the main body 4 of the tackling dummy 2. In FIG. 6A, it can be seen that the tackling dummy 2 has a plurality (preferably three) of spaced apart straps 90 sewn to the outer surface of the main body 4 thereof, preferably near the top end portion 6 thereof. The free end of each strap 90 includes one section of a mating buckle 92. The inside diametrical surface of the ring also includes a plurality of straps 94 sewn thereto and extending upwardly therefrom, positioned to be in alignment with the straps 90 of the dummy 2. The free ends of each of the training ring straps 94 include the other section of the mating buckle 92. Either or both of the dummy straps 90 and the training ring straps 94 may be adjustable in length. In this way, the training ring 54 may be suspended in a desired position along the length of the tackling dummy 2 by adjusting the straps 90, 94 and securing the ends of the buckles 92 together.

FIG. 6B shows an alternative way to selectively affix the training ring 54 in a desired position along the axial length of the tackling dummy 2. As can be seen from FIG. 6, the inside diametrical surface includes a strip 96 of VELCRO™ hook and loop fastening material (preferably circumferentially disposed on the inner surface). On the outer surface of the tackling dummy 2 and preferably extending in a axial direction is affixed one or more strips 98 of mating VELCRO™ hook and loop fastening material. The training ring 54, which is preferably a C-shaped member as shown in FIG. 6B, may be expanded and placed about the outer surface of the tackling dummy in any desired position thereon and held in place by the mating hook and loop fastening strips 96, 98 disposed on the training ring 54 and the tackling dummy 2.

In another preferred form of the tackling dummy apparatus of the present invention, the tensioner 32 is adjustably positionable between the first and second brackets 20*a*, 20*b* of the release mechanism 15 to provide different magnitudes of bias on the first and second brackets. Preferably, the tensioner 32 has a first end 33*a* and a second end 33*b* situated axially opposite the first end 33*a*. Also, each of the first and second brackets 20*a*, 20*b* of the release mechanism 15 preferably has formed therein an elongated window 34. Each elongated window 34 extends longitudinally along a portion of the length of the respective first and second brackets 20*a*, 20*b* in which it is formed. The first end 33*a* of the tensioner 32 is receivable by and securable within the elongated window 34 of the first bracket 20*a* at a selectable position therein, and the second end 33*b* of the tensioner 32 is receivable by and securable within the elongated window 34 of the second bracket 20*b* at a selectable position therein.

It should also be realized that the training ring 54 described herein need not be used in conjunction with the other features of the present invention, including the support structure 10 and the release mechanism 15, also described herein. More specifically, the training ring 54 may be mounted on a conventional tackling dummy which has a generally cylindrical shape, and the ring 54 is positionable along the longitudinal length of the tackling dummy in a manner as described herein to help train a football player as to where the football player should tackle an opponent. Also, it is envisioned to be within the scope of the present invention to form the training ring 54 as an entirely closed member (as opposed to a C-shaped member) having a central opening, much like a donut in shape, which encircles the tackling dummy 2 and yet is preferably adjustable in its position on the main body of the tackling dummy, such as described herein.

It is also envisioned to be within the scope of the present invention to add a locking mechanism that locks the first and second brackets 20*a*, 20*b* of the release mechanism 15 together so that the tackling dummy 2 will not be released by the release mechanism. For example, a bar 80 that is pivotably mounted at a first axial end thereof on a pivot pin 82 to one of the brackets 20, for example, the second bracket 20*b*, and which has a groove or pocket 84 formed in a second axial end thereof, which can accept a pin, screw or bolt 86, having an enlarged head, that extends outwardly from a surface of the other bracket, such as the first bracket 20*a*, may be used to link the two brackets 20*a*, 20*b* together in their closed position so that they will not separate and release the tackling dummy 2 when a force is applied by a football player to the dummy 2. The bar 80 may be pivoted on the pivot pin 82 of the second bracket 20*b* so that the first axial end of the bar 80 does not engage the locking pin 86 situated on the first bracket 20*a* such that the release mechanism 15 will function normally and will allow the brackets 20*a*, 20*b* to separate and release the dummy 2 when sufficient force is applied to the dummy 2. Of course, it should be realized that the latching bar 80 may extend between the two support pieces 40*a*, 40*b*, rather than the brackets 20*a*, 20*b*, with the pivot pin 82 situated on one of the support pieces and the locking pin 86 situated on the other of the support pieces, in order to selectively maintain the support pieces in a closed relative position.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A tackling dummy apparatus, which comprises:

a tackling dummy;

a support structure for suspending the tackling dummy therefrom; and a release mechanism mounted on the support structure and situated between the support structure and the tackling dummy, the tackling dummy being releasably attached to the release mechanism and being released thereby when a predetermined force is applied to the tackling dummy;

wherein the release mechanism includes:

a first bracket and a second bracket, each of the first and second brackets having an end portion, the first bracket and the second bracket being adjustably spaced from each other and being movable relative to each other between at least a first, closed relative position in which the end portions thereof are spaced apart from each other a first distance, and a second, open relative position in which the end portions thereof are spaced apart from each other a second distance which is greater than the first distance;

a tensioner situated between and coupled to the first and second brackets and biasing the first and second brackets toward one another and into the first, closed relative position;

a first cup portion and a second cup portion, the first cup portion being joined to the end portion of the first bracket, and the second cup portion being joined to the end portion of the second bracket and facing the first cup portion, the first cup portion and the second cup portion being in close proximity to each other when the first and second brackets are in the first, closed relative position to define a support cup having a concave inner surface and a central opening formed in the support cup, and being separated from each other by a space when the first and second brackets are in the second, open relative position;

and wherein the tackling dummy includes:

a main body having a top end portion and a bottom end portion situated axially opposite the top end portion;

an elongated shaft extending axially outwardly from the top end portion, the elongated shaft having a distal free end; and an enlarged head mounted on the distal free end of the shaft, the enlarged head having a generally convex underside surface;

wherein the head of the tackling dummy is receivable by the support cup defined by the first and second cup portions and supported by the support cup, with the convex underside surface of the head facing the concave inside surface of the support cup, and with the shaft of the tackling dummy being received by the central opening of the support cup, when the first bracket and the second bracket are in the first, closed relative position;

wherein the tackling dummy is released and unsupported by the support cup of the release mechanism, with the enlarged head of the tackling dummy passing through the space between the first and second cup portions, when the first and second brackets are in the second, open relative position;

and wherein the first and second brackets move relative to each other from the first, closed relative position to the second, open relative position when the predetermined force is applied to the tackling dummy releasably mounted on the release mechanism, to overcome the bias of the tensioner on the first and second brackets.

2. A tackling dummy apparatus as defined by claim 1, wherein the tackling dummy apparatus further comprises:

a tackling training ring, the tackling training ring being at least partially circumferentially mounted on the main body of the tackling dummy and being positionable thereon along at least a portion of the axial length thereof.

3. A tackling dummy apparatus as defined by claim 2, wherein the ring is formed as a C-shaped member having two opposite ends which face each other and which are separated by a space.

4. A tackling apparatus as defined by claim 3, wherein the ring includes a closure member, the closure member straddling the space between the two opposite ends of the C-shaped member, the closure member selectively exerting a force on the ends of the C-shaped member to pull the ends toward each other and to decrease the space therebetween.

5. A tackling dummy apparatus as defined by claim 2, which further comprises:

at least one strap, the at least one strap encircling the circumference of the main body of the tackling dummy and being situated thereon at least one of above and below the ring to maintain the ring in a particular position on the main body of the tackling dummy.

6. A tackling dummy apparatus as defined by claim 1, which further comprises:

a locking mechanism, the locking mechanism being coupled to the release mechanism to prevent the tackling dummy from being released by the release mechanism when the predetermined force is applied to the tackling dummy.

7. A tackling dummy apparatus as defined by claim 2, wherein the training ring includes at least one strap affixed to and extending from a surface thereof; and wherein the main body of the tackling dummy includes at least one strap affixed to a surface thereof, and wherein the at least one strap of the training ring and the at least one strap of the tackling dummy has a free end and a buckle section, the buckle sections being selectively joinable together to suspend the training ring on the tackling dummy.

8. A tackling dummy apparatus as defined by claim 2, wherein the training ring includes at least a first strip of hook and loop fastening material affixed to a surface thereof, and wherein the tackling dummy includes at least a second strip of hook and loop fastening material affixed to a surface of the main body thereof which is mateable with the at least first strip of hook and loop fastening material to selectively affix the training ring in a desired position along at least a portion of the longitudinal length of the main body of the tackling dummy.

9. A tackling dummy apparatus as defined by claim 1, wherein the support structure includes an elongated tubular member, and wherein the tackling dummy apparatus further comprises:

a roller assembly, the roller assembly including a pair of spaced apart brackets and at least one roller rotatably mounted to and extending between the spaced apart brackets of the roller assembly, the at least one roller being engageable with the elongated tubular member, the release mechanism being mounted to the roller assembly.

10. A tackling dummy apparatus as defined by claim 9, wherein the roller assembly includes a first roller and a second roller, the first and second rollers being arranged in parallel and being spaced apart from each other, the first and second rollers being rotatably mounted to and extending between the spaced apart brackets of the roller assembly, each of the first and second rollers having a concave roller surface, the elongated tubular member of the support structure being received between the first and second rollers.

11. A tackling dummy apparatus as defined by claim 1, wherein the tensioner is adjustably positionable between the first and second brackets of the release mechanism to provide different magnitudes of bias on the first and second brackets.

12. A tackling dummy apparatus as defined by claim 11, wherein the tensioner has a first end and a second end situated axially opposite the first end, and wherein each of the first and second brackets of the release mechanism has formed therein an elongated window, each elongated window extending longitudinally along a portion of the length of the respective first and second brackets in which it is formed, the first end of the tensioner being receivable by and securable within the elongated window of the first bracket at a selectable position therein, the second end of the tensioner being receivable by and securable within the elongated window of the second bracket at a selectable position therein.

13. A tackling dummy apparatus as defined by claim 1, which further comprises:

a locking mechanism, the locking mechanism being coupled to the release mechanism to prevent the tackling dummy from being released by the release mechanism when the predetermined force is applied to the tackling dummy, the locking mechanism including a latching bar, the latching bar selectively coupled to and between one of the first and second brackets and the first and second cup portions respectively joined to the first and second brackets, the latching bar selectively maintaining the first and second cup portions in the first, closed relative position.

14. A tackling dummy apparatus, which comprises:

a tackling dummy;

a support structure for suspending the tackling dummy therefrom; and a release mechanism mounted on the support structure and situated between the support structure and the tackling dummy, the tackling dummy being releasably attached to the release mechanism and being released thereby when a predetermined force is applied to the tackling dummy;

wherein the release mechanism includes:

first and second brackets, the first and second brackets being spaced apart from each other and being movable relative to each other;

a tensioner situated between and coupled to the first and second brackets, the tensioner applying a bias on the first and second brackets to pull the first and second brackets towards each other; and first and second cooperating support pieces respectively joined to the first and second brackets, the first and second support pieces facing each other and being movable relative to each other with movement of the first and second brackets relative to each other, the first and second support pieces being positionable between at least a first relative position and a second relative position, the first and second support pieces together defining an opening between them having a first dimension when the first and second support pieces are positioned in the first relative position, the opening between the first and second support pieces having a second dimension which is larger than the first dimension when the first and second support pieces are positioned in the second relative position;

and wherein the tackling dummy includes:

a main body having a top end portion and a bottom end portion situated axially opposite the top end portion;

an elongated shaft extending axially outwardly from the top end portion, the elongated shaft having a distal free end; and an enlarged head mounted on the distal free end of the shaft, the enlarged head having a third dimension which is greater than the first dimension of the opening between the first and second support pieces when the first and second support pieces are in the first relative position, the third dimension of the enlarged head being less than the second dimension of the opening between the first and second support pieces when the first and second support pieces are in the second relative position;

wherein the shaft of the tackling dummy is captively received by the opening between the first and second support pieces and the enlarged head being supported by the first and second support pieces when the first and second support pieces are in the first relative position and the opening has the first dimension;

and wherein the enlarged head of the tackling dummy passes through the opening between the first and second support pieces and being unsupported thereby when the first and second support pieces move from the first relative position to the second relative position and the opening has the second dimension.

15. A tackling dummy apparatus as defined by claim 14, wherein the support structure includes an elongated tubular member, and wherein the tackling dummy apparatus further comprises:

a roller assembly, the roller assembly including a pair of spaced apart brackets and at least one roller rotatably mounted to and extending between the spaced apart brackets of the roller assembly, the at least one roller being engageable with the elongated tubular member, the release mechanism being mounted to the roller assembly.

16. A tackling dummy apparatus as defined by claim 15, wherein the roller assembly includes a first roller and a second roller, the first and second rollers being arranged in parallel and being spaced apart from each other, the first and second rollers being rotatably mounted to and extending between the spaced apart brackets of the roller assembly, each of the first and second rollers having a concave roller surface, the elongated tubular member of the support structure being received between the first and second rollers.

17. A tackling dummy apparatus as defined by claim 14, wherein the tensioner is adjustably positionable between the first and second brackets of the release mechanism to provide different magnitudes of bias on the first and second brackets.

18. A tackling dummy apparatus as defined by claim 17, wherein the tensioner has a first end and a second end situated axially opposite the first end, and wherein each of the first and second brackets of the release mechanism has formed therein an elongated window, each elongated window extending longitudinally along a portion of the length of the respective first and second brackets in which it is formed, the first end of the tensioner being receivable by and securable within the elongated window of the first bracket at a selectable position therein, the second end of the tensioner being receivable by and securable within the elongated window of the second bracket at a selectable position therein.

19. A tackling dummy apparatus as defined by claim 14, which further comprises:

a locking mechanism, the locking mechanism being coupled to the release mechanism to prevent the tackling dummy from being released by the release mechanism when the predetermined force is applied to the tackling dummy, the locking mechanism including latching bar, the latching bar selectively coupled to and between one of the first and second brackets and the first and second cooperating support pieces respectively joined to the first and second brackets, the latching bar selectively maintaining the first and second support pieces in the first relative position.

20. A tackling dummy apparatus as defined by claim 14, wherein the tackling dummy apparatus further comprises:

a tackling training ring, the tackling training ring being at least partially circumferentially mounted on the main body of the tackling dummy and being positionable thereon along at least a portion of the axial length thereof.

21. A tackling dummy apparatus as defined by claim 20, wherein the ring is formed as a C-shaped member having two opposite ends which face each other and which are separated by a space.

22. A tackling apparatus as defined by claim 21, wherein the ring includes a closure member, the closure member straddling the space between the two opposite ends of the C-shaped member, the closure member selectively exerting a force on the ends of the C-shaped member to pull the ends toward each other and to decrease the space therebetween.

23. A tackling dummy apparatus as defined by claim 20, which further comprises:

at least one strap, the at least one strap encircling the circumference of the main body of the tackling dummy and being situated thereon at least one of above and below the ring to maintain the ring in a particular position on the main body of the tackling dummy.

24. A tackling dummy apparatus as defined by claim 14, which further comprises:

a locking mechanism, the locking mechanism being coupled to the release mechanism to prevent the tackling dummy from being released by the release mechanism when the predetermined force is applied to the tackling dummy.

25. A tackling dummy apparatus as defined by claim 20, wherein the training ring includes at least one strap affixed to and extending from a surface thereof; and wherein the main body of the tackling dummy includes at least one strap affixed to a surface thereof, and wherein the at least one strap of the training ring and the at least one strap of the tackling dummy has a free end and a buckle section, the buckle sections being selectively joinable together to suspend the training ring on the tackling dummy.

26. A tackling dummy apparatus as defined by claim 20, wherein the training ring includes at least a first strip of hook and loop fastening material affixed to a surface thereof, and wherein the tackling dummy includes at least a second strip of hook and loop fastening material affixed to a surface of the main body thereof which is mateable with the at least first strip of hook and loop fastening material to selectively affix the training ring in a desired position along at least a portion of the longitudinal length of the main body of the tackling dummy.

* * * * *